US005800227A

United States Patent [19]

Brown, Jr.

[11] Patent Number: 5,800,227

[45] Date of Patent: Sep. 1, 1998

[54] SELF ERECTING PERSONAL WATER SAFETY DEVICE

[76] Inventor: Robert Edward Brown, Jr., 8 Melba Dr., Hudson, N.H. 03051

[21] Appl. No.: 824,528

[22] Filed: Mar. 26, 1997

[51] Int. Cl.[6] ..... B63C 9/08

[52] U.S. Cl. ..... 441/80; 441/89

[58] Field of Search ..... 441/80, 88, 89

[56] References Cited

U.S. PATENT DOCUMENTS

| | | | |
|---|---|---|---|
| 3,095,568 | 6/1963 | Aine et al. | 441/89 |
| 3,638,258 | 2/1972 | Black | 441/89 |
| 4,598,661 | 7/1986 | Roe | 441/89 |
| 5,083,956 | 1/1992 | Chraghchian et al. | 441/80 |
| 5,344,351 | 9/1994 | Danielson | 441/89 |

FOREIGN PATENT DOCUMENTS

| | | | |
|---|---|---|---|
| 4115206 | 11/1992 | Germany | 441/89 |

*Primary Examiner*—Stephen Avila
*Attorney, Agent, or Firm*—Iandiorio & Teska

[57] ABSTRACT

A self erecting personal water safety device includes a marker device having a flag portion and a base portion normally in the collapsed state; an erection chamber in the flag portion and a compressible storage chamber in the base portion for storing an actuating fluid and interconnected with the erection chamber for compressing when submerged in water to transfer fluid to the erection chamber and erect the flag portion.

11 Claims, 4 Drawing Sheets

SELF ERECTING PERSONAL WATER SAFETY DEVICE

FIELD OF INVENTION

This invention relates to a self erecting personal water safety device, and more particularly to such a device which transitions from the collapsed to the erected state to display a warning flag automatically by the action of water pressure on the device.

BACKGROUND OF INVENTION

In any water sport or activity whether it be boating, fishing, water skiing, jet skiing or even commercial activity one of the greatest dangers is drowning. This problem has been met by the use of life preservers, flotation vests and other personal flotation devices. However, another danger equally as life threatening is the loss of visibility of a downed skier or man overboard. This often happens in stormy waters and heavy seas but it also a danger in choppy waters such as on inland lakes and ponds where the choppy waters can be caused by the boating activity itself in heavy traffic areas. When a downed person is not easily visible not only is he in danger of being lost but he is also in danger of being hit or run down by another boat or even the boat from which he is separated.

SUMMARY OF INVENTION: I

It is therefore an object of this invention to provide a simple, self erecting personal water safety device.

It is a further object of this invention to provide such a self erecting personal water safety device by operation of water pressure on the device which erects automatically by operation of water pressure on the device.

It is a further object of this invention to provide such a self erecting personal water safety device which erects automatically when the device and the person wearing it become at least partially submerged.

It is a further object of this invention to provide such a self erecting personal water safety device which normally resides in a collapsed state and only erects when in the water under the pressure of the water.

It is a further object of this invention to provide such a self erecting personal water safety device is repeatedly reusable without recharging.

This invention results from the realization that a simple, reliable, repeatedly reusable personal water safety device can be effected with a marker device which is normally collapsed but contains a storage chamber full of fluid, which when the marker device and the person wearing it are in the water, becomes subject to water pressure which transfers fluid to an erection chamber in a flag portion to erect the flag portion so that it is easily visible at a distance and even in choppy waters.

This invention features a self erecting personal water safety device including a marker device having a flag portion and a base portion normally in the collapsed state. There is an erection chamber in the flag portion and compressible storage chamber in the base portion for storing an actuating fluid. The storage chamber is interconnected with the erection chamber for compressing once submerged in water to transfer fluid to the erection chamber and erect the flag portion.

In a preferred embodiment the erection chamber may include two segments the fluid may be air, the storage chamber may include a filler valve and the flag portion of the base portion may be folded over on each other on the collapsed state. The portions may include a securing device for securing them together in the collapsed state and being releasable by the erection of the erection chamber. The securing device may include a hook and loop fastener. The marker device may include an attachment device for releasably attaching to a person. Their marker device may include a mounting device for mounting to a water flotation vest. The flag portion may include a weighting medium to bias the flag portion to remain in the collapsed state. The weighting medium may be buoyant to urge the flag portion to separate from the base portion when the base portion is submerged.

DISCLOSURE OF PREFERRED EMBODIMENT

Other objects, features and advantages will occur to those skilled in the art from the following description of a preferred embodiment and the accompanying drawings, in which.

Figure 1:
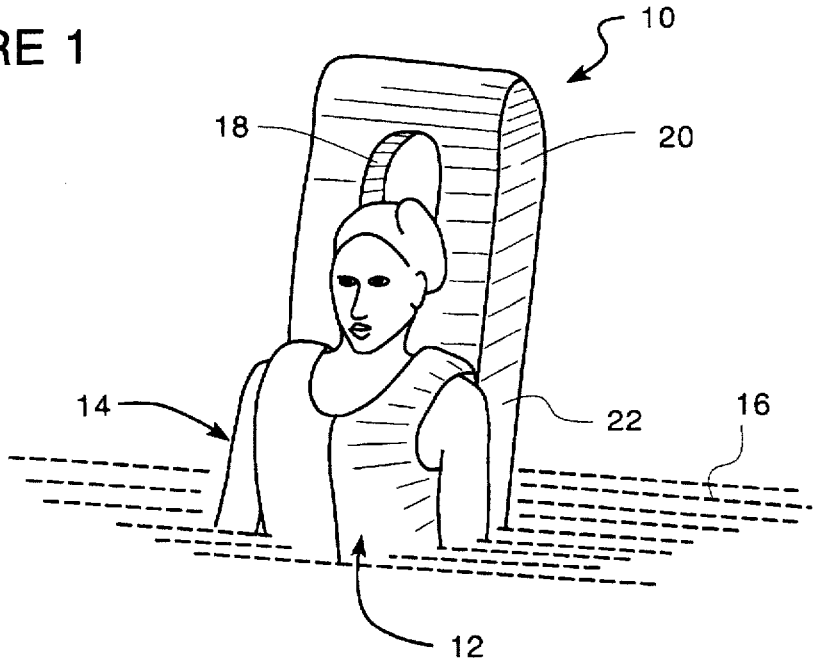
FIG. 1 is a diagrammatic three dimensional view of a person submerged in the water wearing a vest and a self erecting personal water safety device according to this invention which is in the erected state.

There is shown in FIG. 1 a self erecting personal water safety device 10, according to this invention, in the erected form mounted to a conventional safety flotation device such as water vest 12, worn by a person 14, who is in the water 16 and partially submerged. Water safety device 10 has a cut-out or recess 18, for comfort to accommodate the head of the wearer. Water safety device 10 includes a flag portion 20, which is up, erected and visible in FIG. 1 and a base portion 22. In a collapsed state, FIG. 2, device 10 has its flag portion 20 folded over onto its base portion 22. Water safety device 10, FIG. 3, can be attached to vest 12 by passing one or more straps 30 and 32 through mounting loops 34, 36, and 38, 40 of vest 12 and through loops 42, 44, 46 and 48 respectively of water safety device 10. Device 10 can be worn directly by a person by providing separate straps 50 and 52. Alternatively, device 10 may be incorporated directly into a vest.

Figure 4:
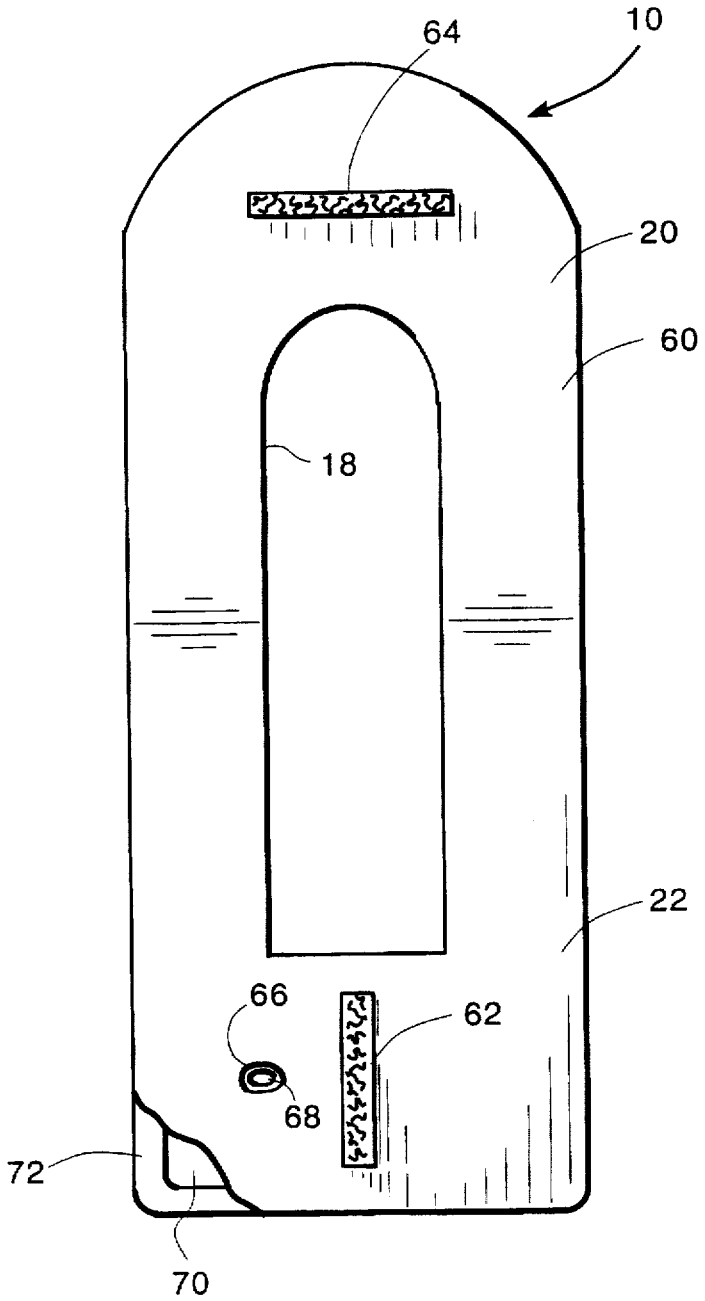
FIG. 4 is a rear elevational view of the self erecting personal water safety device according to this invention in the erected state.

In the open elevational view of FIG. 4, panel 60 is provided with a hook and loop or VELCRO strap 62, vertically mounted in the base portion 22 and a horizontally mounted companion hook and loop or Velcro strap 64 so that when flag portion 20 is folded over on flag portion 22 the two parts are held together. The orthogonal orientation of straps 62 and 64 insure a wide range of alignment where the straps can interact. A hole 66 in base 22 provides access to filler valve 68 through which storage chamber 70 can be initially filled. Top panel 60 is fastened to frame 72 by stitching or any other suitable means.

Figure 2:
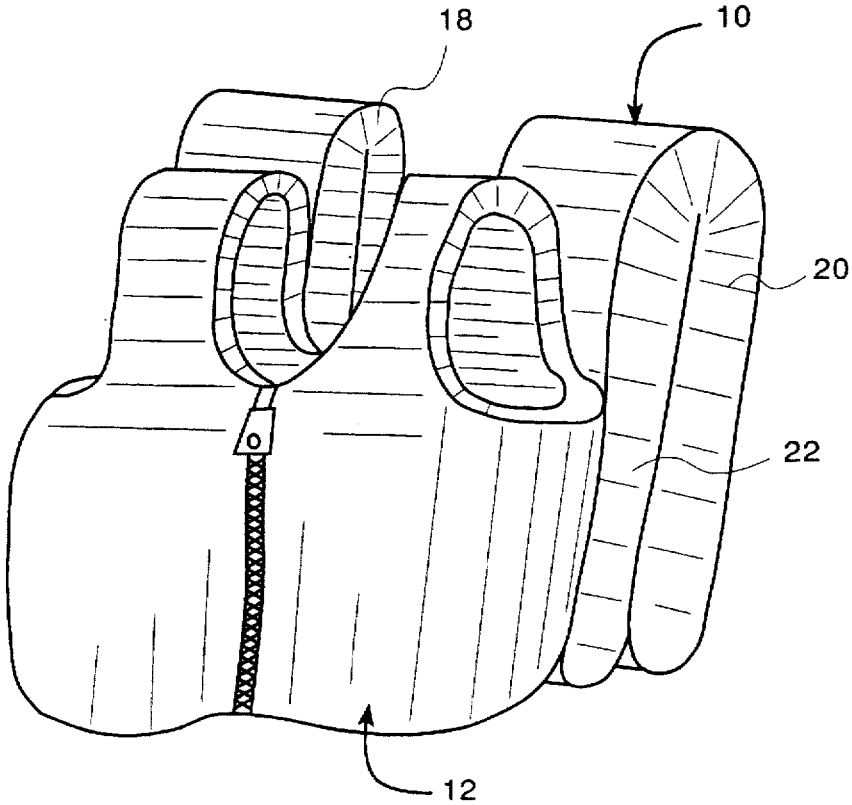
FIG. 2 is a three dimensional view of the self erecting personal water safety device and vest of FIG. 1 with the water safety device in a collapsed state.
Figure 3:
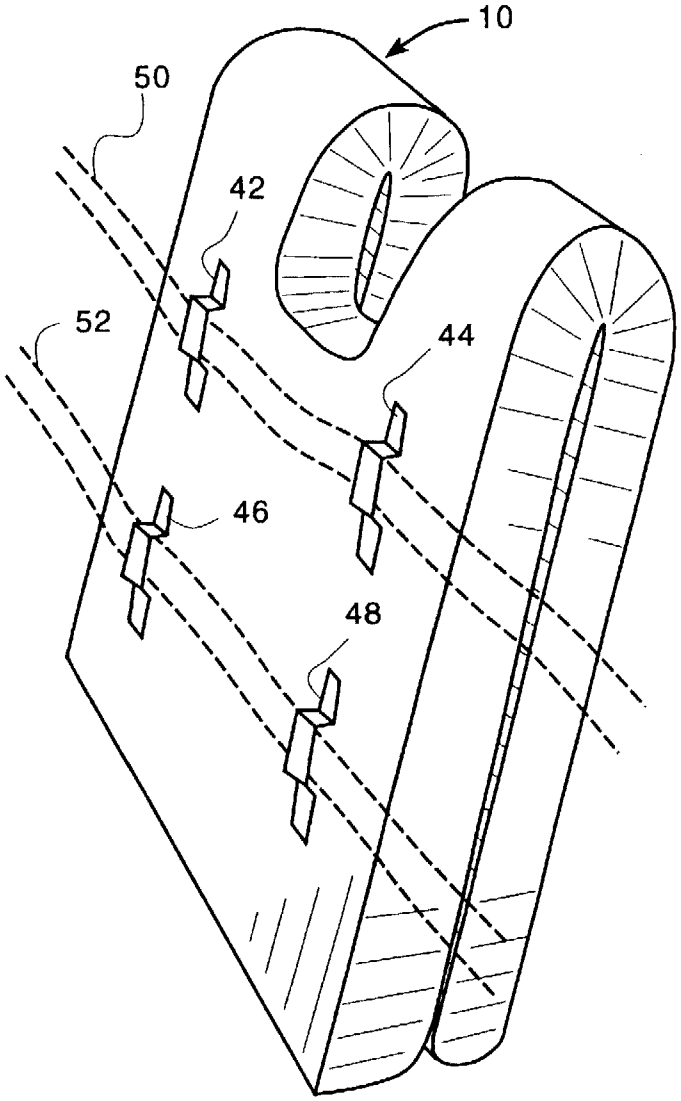
FIG. 3 is an exploded three dimensional view showing the attachment of the vest and water safety device according to this invention showing one means of interconnecting the vest and water safety device of this invention as shown in FIG. 2.
Figure 3:
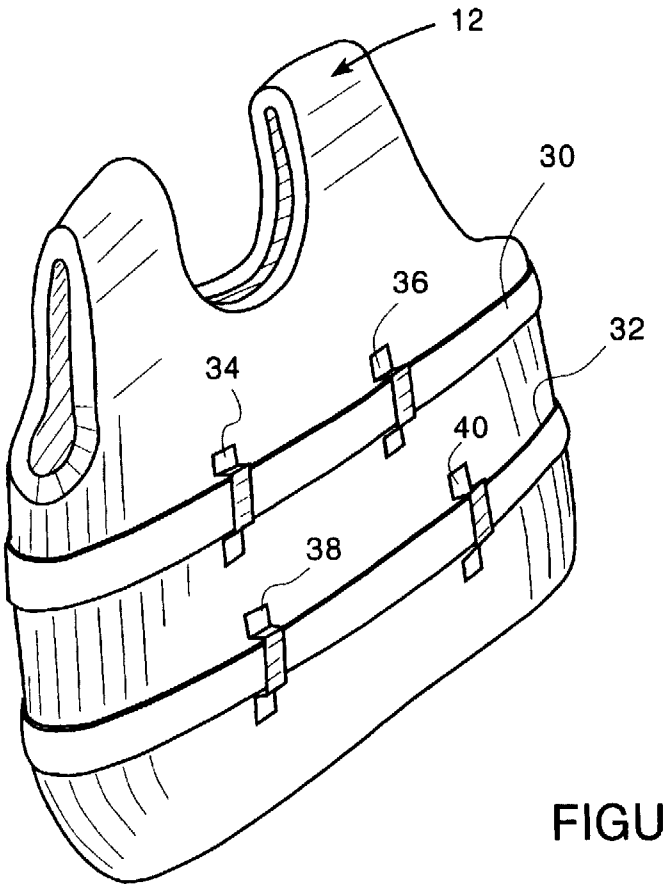
Figure 5:
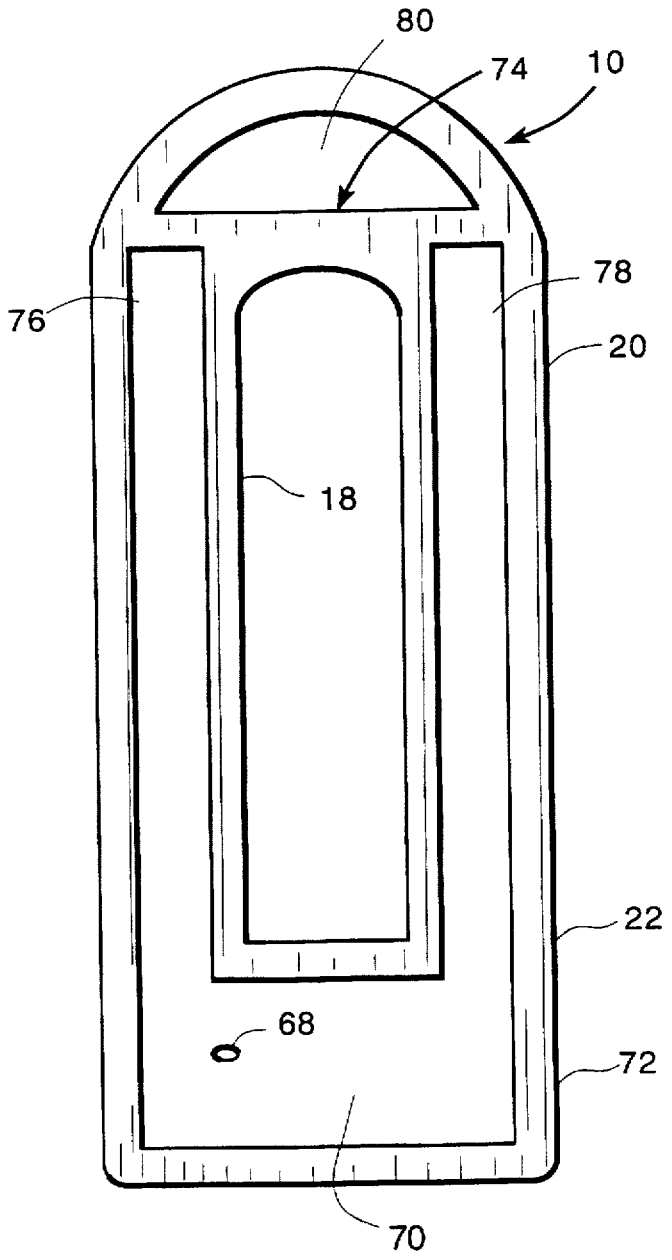
FIG. 5 is a view similar to FIG. 4 with the front panel removed to reveal the storage and erection chamber.

The actuating structure is shown more clearly in FIG. 5 where top panel 60 has been removed for clarity. Filler valve 68 directly introduces air or other fluid into storage chamber 70 which interconnects directly with erection chamber 74 that includes two sections or arms 76 and 78. In operation with air in storage chamber 70, when the device 10 is submerged so at least a significant portion of storage chamber 70 is under water, the pressure of the water compresses storage chamber 70 and transfers air up into arms or sections 76, 78 of erection chamber 74. This causes them to straighten out and erect flag portion 20 so that it stands straight up from base portion 22 as shown in FIG. 1. The force is sufficient to erect and hold flag portion 20 in the erected position and also to initially separate VELCRO straps 62 and 64 from one another. Thus, in the collapsed state as shown in FIGS. 2 and 3 the holding force of VELCRO straps 62 and 64 or some other fastening means is adequate to hold device 10 in a comfortable and collapsed state with flag portion 20 folded on base portion 22. But the holding force is able to be overcome by the erection of flag portion 20 with respect to base 22. A weighting member or mass 80, FIG. 5, may be placed at the top of flag portion 20 so that when flag portion 20 is collapsed onto base portion 22 the weight 80 tends to keep it down. Of course the weight of portion 80 is not so great that it cannot be easily lifted by the erection of flag portion 20. Weight 80 may also be made of buoyant material such as polyethylene foam, polyvinylchloride foam or other buoyant materials so that in the collapsed state the buoyant force created when the device is submerged aids in breaking away flag portion 20 from base portion 22 against the holding force of VELCRO strips 62, 64 or other fasteners.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. A self erecting personal water safety device comprising:

a marker device having a flag portion and a base portion normally in a collapsed state;

an erection chamber in said flag portion; and a compressible storage chamber in said base portion for storing an actuating fluid and interconnected with said erection chamber for compressing when submerged in water to transfer fluid from said compressible storage chamber to said erection chamber and to automatically erect said flag portion when the base portion is submerged in water.

2. The self erecting personal water safety device of claim 1 in which said erection chamber includes two segments.

3. The self erecting personal water safety device of claim 1 in which said fluid is air.

4. The self erecting personal water safety device of claim 1 in which said storage chamber includes a filler valve.

5. The self erecting personal water safety device of claim 1 in which said flag portion and base portion are folded over on each other in the collapsed state.

6. A self erecting personal water safety device of claim 5 in which said portions include a securing device for securing them together in the collapsed state and being releasable by the erection of said erection chamber.

7. A self erecting personal water safety device of claim 6 in which said securing device includes a hook and loop fastener.

8. A self erecting personal water safety device of claim 1 in which said marker device includes an attachment device for releasably attaching to a person.

9. A self erecting personal water safety device of claim 1 in which said marker device includes a mounting device for mounting to a water flotation vest.

10. A self erecting personal water safety device of claim 1 in which said flag portion includes a weighting medium to bias said flag portion to remain in the collapsed state.

11. A self erecting personal water safety device of claim 10 in which said weighting member is buoyant to urge said flag portion to separate from said base portion when said base portion is submerged.

* * * * *